US012195930B1

(12) United States Patent
Kim et al.

(10) Patent No.: US 12,195,930 B1
(45) Date of Patent: Jan. 14, 2025

(54) ARTIFICIAL TURF SYSTEM HAVING SHOCK ABSORBING PAD

(71) Applicant: Bong Jin Kim, Incheon (KR)

(72) Inventors: Bong Jin Kim, Incheon (KR); Soo Hyoung Kim, Gyeongsangbuk-do (KR)

(73) Assignee: Bong Jim Kim, Incheon (KR)

( * ) Notice: Subject to any disclaimer, the term of this patent is extended or adjusted under 35 U.S.C. 154(b) by 0 days.

(21) Appl. No.: 18/235,926

(22) Filed: Aug. 21, 2023

(51) Int. Cl.
*E01C 13/08* (2006.01)

(52) U.S. Cl.
CPC ..... *E01C 13/08* (2013.01)

(58) Field of Classification Search
None
See application file for complete search history.

(56) References Cited

U.S. PATENT DOCUMENTS

2006/0208390 A1* 9/2006 Charbonneaux ..... A61P 31/10 264/165
2020/0121816 A1* 4/2020 Grossman ..... A01G 20/30

FOREIGN PATENT DOCUMENTS

KR 20190023124 3/2019
KR 20220051452 A * 4/2022

OTHER PUBLICATIONS

Wang et al., "Synthesis and characterization of ZnS with controlled amount of S vacancies for photocatalytic H2 production under visible light", Feb. 25, 2015, Scientific Reports, vol. 5, 8544; DOI:10.1038/srep08544. (Year: 2015).*

* cited by examiner

*Primary Examiner* — Kim S. Horger
(74) *Attorney, Agent, or Firm* — IPLA P.A.

(57) ABSTRACT

An artificial turf system includes: a lower member located to come into close contact with the ground; an upper member spaced apart from the lower member; the shock absorbing pad placed between the lower member and the upper member and made of materials having given elasticity to absorb the shock received from the artificial turf assembly; and the artificial turf assembly seated onto the top of the upper member and having a backing cloth having brushes located on one surface thereof, silica sand poured inside the brushes where artificial turf is planted, and the artificial turf fixed to the inside of the brushes and made of an antibacterial material.

3 Claims, 4 Drawing Sheets

FIG. 4

| Components | Mixing time | Time passing | Reduction rate of viral infectivity of antibacterial material |
|---|---|---|---|
| Antibacterial material made by mixing 149.15 to 149.35 parts by weight of the ABS resin and 0.70 to 0.80 parts by weight of the visible light photocatalyst for four to six minutes | 4~6 mins | 1 hr | 90% |
| | | 4 hrs | 98% |
| | | 6 hrs | 99.806% |

FIG. 5

| Components | Mixing time | Time passing | Reduction rate of viral infectivity of antibacterial material |
|---|---|---|---|
| Antibacterial material made by mixing 148 to 150 parts by weight of the ABS resin, 0.90 to 1.10 parts by weight of the visible light photocatalyst, and 4 to 6 parts by weight of antibacterial copper powder | 4~6 mins | 1 hr | 90% |
| | | 4 hrs | 99.035% |
| | | 6 hrs | 99.906% |

FIG. 6

| Components | Mixing time | Time passing | Reduction rate of viral infectivity of antibacterial material |
|---|---|---|---|
| Antibacterial material made by mixing 0.5 to 1 parts by weight of visible light photocatalyst, 0.5 to 1 parts by weight of silver nano powder, 50 parts by weight of recyclable plastic, and 48 to 49 parts by weight of the non-recyclable plastic for four to six minutes | 4~6 mins | 1 hr | 90% |
| | | 4 hrs | 99.035% |
| | | 6 hrs | 99.906% |

ARTIFICIAL TURF SYSTEM HAVING SHOCK ABSORBING PAD

BACKGROUND

The present invention relates to an artificial turf system having a shock absorbing pad, more particularly to an artificial turf system that is configured to have a lower member located to come into close contact with the ground, an upper member spaced apart from the lower member by a given distance to allow an artificial turf assembly to be seated onto top thereof, and a shock absorbing pad placed between the lower member and the upper member and having given elasticity and drain functions, thereby improving performance, such as durability, drainage, and the like.

Generally, turf is built on a sports ground or playground where sports games or events happen, thereby upgrading an outer appearance of the sports ground or playground and protecting players from shocks occurring upon the sports games or events.

For example, natural turf serves to relieve a player's shock applied to the ground, and in summer seasons, the natural turf absorbs geothermal heat therearound to improve the environments of the sports games or events. Accordingly, the natural turf has been used in various fields.

In the case of the natural turf, however, there are many difficulties in cultivating and managing the natural turf, and a lot of hours are needed until turf is first planted on the surface of the ground and roots are then anchored in the soil of the ground. Further, many labors and high costs for consistent maintenance and repair of the natural turf are consumed, thereby causing many limitations in using the natural turf.

Therefore, various methods for covering the surface of the sports ground with artificial turf as a natural turf alternative have been suggested and developed.

The artificial turf is for the first time adopted in an indoor baseball ground, also known as the Astrodome in 1966, which is located in Texas, United States. The artificial turf is widely adopted in a multi-purpose facility such as a soccer field, a field hockey stadium, various kinds of indoor interiors, leisure facilities, and the like. Further, the artificial turf is developed to reduce the maintenance cost of the sports ground where violent or aggressive activities occur, to allow the surface of the sports ground where professional sports games are played to become more evenly flatten, and to improve the durability of the surface on which the artificial turf is located.

Such artificial turf has to serve to relieve the shocks applied thereto during the player's activities and needs a drain plate for draining water staying on the sports ground when it rains.

However, conventional artificial turf fails to perfectly absorb the shocks generated during the player's activities and does not have appropriate drain functions, and therefore, there is a need to develop a new artificial turf system capable of solving the above-mentioned problems.

SUMMARY OF THE INVENTION

Accordingly, the present invention has been made in view of the above-mentioned problems occurring in the related art, and it is an object of the present invention to provide an artificial turf system that is configured to have a lower member located to come into close contact with the ground, an upper member spaced apart from the lower member by a given distance to allow an artificial turf assembly to be seated onto top thereof, and a shock absorbing pad placed between the lower member and the upper member and having given elasticity and drain functions, thereby improving performance, such as durability, drainage, and the like.

To accomplish the above-mentioned objects, according to the present invention, there is provided an artificial turf system including: a lower member located to come into close contact with the ground; an upper member spaced apart from the lower member by a given distance to allow an artificial turf assembly to be seated onto top thereof; a shock absorbing pad placed between the lower member and the upper member and made of materials having given elasticity to absorb the shock received from the artificial turf assembly; and the artificial turf assembly seated onto the top of the upper member.

According to the present invention, desirably, the lower member may be made of any one selected from a non-woven fabric, a PE material, and a PP material or two or more materials thereof to prevent the soil of the ground from being insertedly planted into the shock absorbing pad.

According to the present invention, desirably, the upper member may be made of any one selected from a non-woven fabric, a PE material, and a PP material or two or more materials thereof to absorb water from the artificial turf assembly seated onto top thereof and have a plurality of drain holes spaced apart from one another at given intervals on top thereof to drain water from the artificial turf assembly seated onto top thereof.

According to the present invention, desirably, the shock absorbing pad may be made of the materials having the given elasticity.

According to the present invention, desirably, the shock absorbing pad may have a thickness between 0.3 and 1.5 mm and be configured to allow the elastic materials with given lengths to be freely entangled in such a way as to be placed between the lower member and the upper member or to allow a plurality of springs to be spaced apart from one another in parallel with one another between the lower member and the upper member.

BRIEF DESCRIPTION OF THE DRAWINGS

The above and other objects, features and advantages of the present invention will be apparent from the following detailed description of the embodiments of the invention in conjunction with the accompanying drawings, in which:

FIG. 4 is a Diagram of reduction rate of infection value according to the second embodiment of the present invention.

FIG. 5 is a Diagram of reduction rate of infection value according to the first embodiment of the present invention.

FIG. 6 is a Diagram of reduction rate of infection value according to the third embodiment of the present invention.

DETAILED DESCRIPTION OF THE EMBODIMENTS

Figure 1:
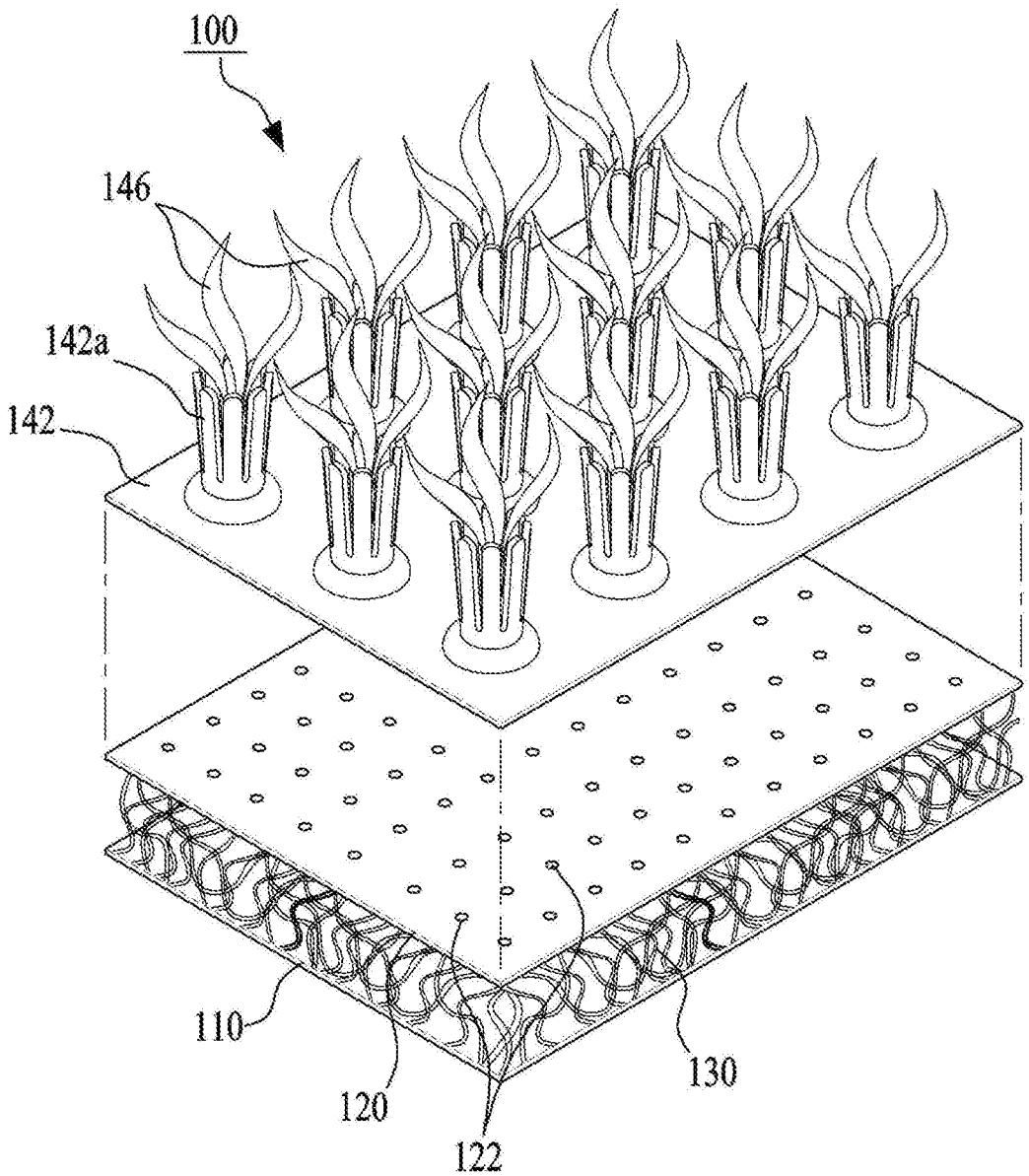
FIG. 1 is an exemplary view showing installation relations of components of an artificial turf system according to the present invention.

Objects, characteristics and advantages of the present invention will be more clearly understood from the detailed description as will be described below and the attached drawings.

Before the present invention is disclosed and described, it is to be understood that the disclosed embodiments are merely exemplary of the invention, which can be embodied in various forms. Those skilled in the art will envision many other possible variations within the scope of the present invention. Further, the parts corresponding to those of the drawings are indicated by corresponding reference numerals.

If it is determined that the detailed explanation on the well known steps, structures, and technologies related to the present invention makes the scope of the present invention not clear, the explanation will be avoided for the brevity of the description.

Terms used in this application are used to only describe specific exemplary embodiments and are not intended to restrict the present invention. An expression referencing a singular value additionally refers to a corresponding expression of the plural number, unless explicitly limited otherwise by the context.

The term 'comprises' and/or 'comprising', as used herein are intended to refer to the above features, numbers, steps, operations, elements, parts or combinations, and it is to be understood that the terms are not intended to preclude the presence of one or more features, numbers, steps, operations, elements, parts or combinations and added possibilities.

A term 'and/or' includes a combination of a plurality of relevant and described items or any one of a plurality of related and described items.

Further, the embodiments of the present invention will be explained with reference to sectional view and/or schematic views as desirable exemplary views of the present invention.

In addition, the embodiments of the present invention may be embodied in different forms and should not be construed as limited to the embodiments set forth herein but may be modified and variously implemented by those skilled in the art.

In the description, the thicknesses of the lines or the sizes of the components shown in the drawings may be magnified for the clarity and convenience of the description.

Hereinafter, an explanation on an embodiment of the present invention will be given in detail with reference to the attached drawing.

Figure 2:
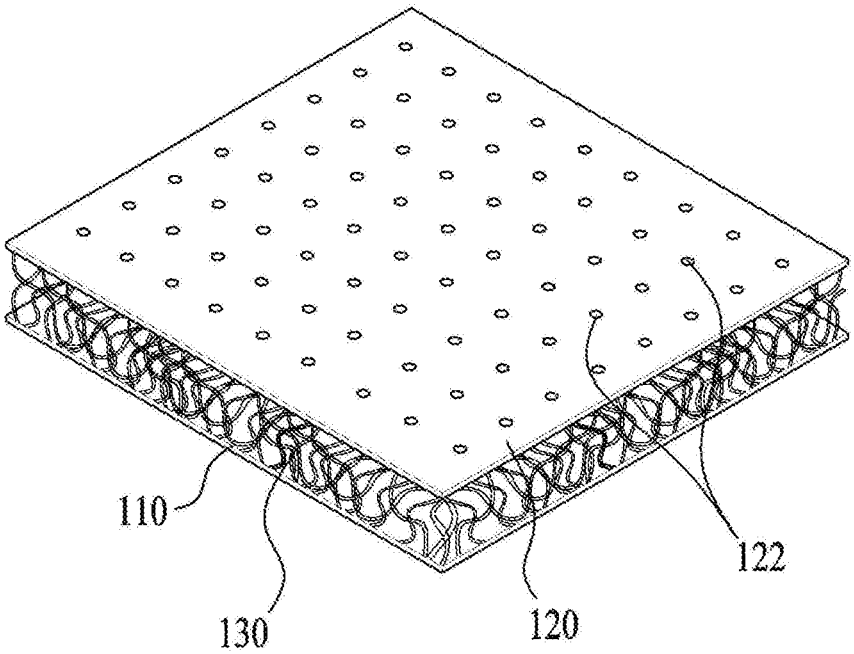
FIG. 2 is a perspective view showing a shock absorbing pad of the artificial turf system according to the present invention.
Figure 3:
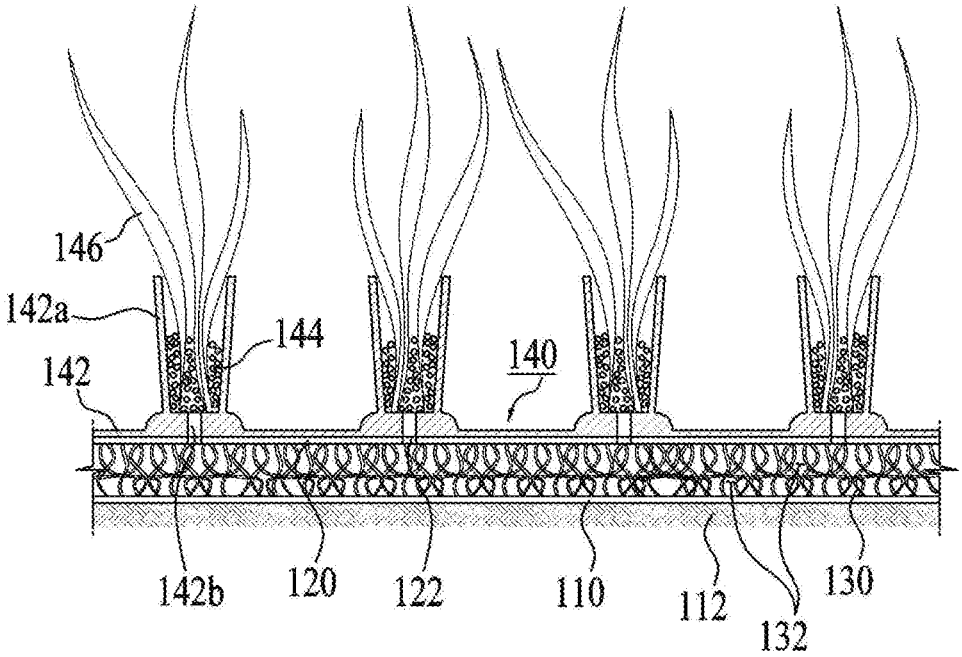
FIG. 3 is an exemplary view showing a state where the artificial turf system according to the present invention is installed.

FIG. 1 is an exemplary view showing installation relations of components of an artificial turf system according to the present invention, FIG. 2 is a perspective view showing a shock absorbing pad of the artificial turf system according to the present invention, and FIG. 3 is an exemplary view showing a state where the artificial turf system according to the present invention is installed.

An artificial turf system 100 according to the present invention includes a lower member 110 located on the ground 112, an upper member 120 for seating an artificial turf assembly 140 thereonto, a shock absorbing pad 130 placed between the lower member 110 and the upper member 120, and the artificial turf assembly 140 seated onto top of the upper member 120.

In this case, the lower member 110 comes into close contact with the ground 112 to prevent the soil of the ground 112 from being insertedly planted into the shock absorbing pad 130.

The lower member 110 is made of any one selected from a non-woven fabric, a polyethylene (PE) material, and a polypropylene (PP) material, and otherwise, the lower member 110 is made of two or more materials thereof.

The upper member 120 is spaced apart from the lower member 110 by a given distance to allow the artificial turf assembly 140 to be seated onto top thereof, as shown in FIGS. 1 and 3.

The upper member 120 is made of any one selected from a non-woven fabric, a PE material, and a PP material, which are the same material as the lower member 110, and otherwise, the upper member 120 is made of two or more materials thereof.

The upper member 120 serves to absorb water from the artificial turf assembly 140 seated onto top thereof and has a plurality of drain holes 122 spaced apart from one another at given intervals to drain water from the artificial turf assembly 140 seated onto top thereof.

The drain holes 122 communicate with drain paths 142*b* formed to pass through the undersides (the bases) of brushes 142*a* arranged on a backing cloth 142 in up and down directions and thus drain water (rainwater or water coming from melted snow in winter).

Further, the shock absorbing pad 130 is one of main components of the present invention, which is placed between the lower member 110 and the upper member 120.

The shock absorbing pad 130 is made of a material having elasticity and desirably absorbs the shock received from the artificial turf assembly 140 where a player's activity occurs.

That is, the shock absorbing pad 130 is desirably made of elastic materials having given elasticity capable of performing a shock relieving (absorbing) function.

The shock absorbing pad 130 has different structures and thicknesses in accordance with installation environments, and the shock absorbing pad 130 has a thickness between 0.1 and 4 mm, desirably a thickness between 0.3 and 1.5 mm in consideration of durability.

If the shock absorbing pad 130 has a thickness between 0.1 and 0.2 mm, it has poor durability, and contrarily, if the shock absorbing pad 130 has a thickness between 1.6 and 4 mm, it has low elasticity. Therefore, it is desirable that the shock absorbing pad 130 have a thickness between 0.3 and 1.5 mm. Under the condition where the shock absorbing pad 130 has good durability and elasticity, however, it may be made freely, regardless of its thickness.

The shock absorbing pad 130 has different structures in accordance with installation environments.

For example, the shock absorbing pad 130 has elastic materials with given lengths freely entangled and is thus fixedly placed between the lower member 110 and the upper member 120, without any escape.

Otherwise, the shock absorbing pad 130 has a plurality of springs spaced apart from one another in parallel with one another between the lower member 110 and the upper member 120.

As shown in FIGS. 2 and 3, the shock absorbing pad 130 having such a structure has given spaces among the elastic materials or springs, which are used as drain spaces 132, so that the rainwater or water coming from melted snow in winter introduced from the drain paths 142*b* of the brushes 142*a* arranged on the backing cloth 142 through the drain holes 122 may be drained through the drain spaces 132.

The artificial turf assembly 140 seated onto the top of the upper member 120 includes the backing cloth 142 having the brushes 142*a* located on one surface thereof, silica sand 144 poured inside the brushes 142*a* where artificial turf 146 is planted, and the artificial turf 146 fixed to the inside of the brushes 142*a*.

In this case, the backing cloth 142 has a given area and has the brushes 142*a* spaced apart from one another by a given distance on one surface thereof, and each brush 142*a* of the backing cloth 142 has a given space formed at the interior thereof to allow the artificial turf 146 to be fixedly planted therein.

Each brush 142*a* has given tension and absorbs shocks applied thereto together with the artificial turf 146 to protect sports players playing on the artificial turf 146 from the shocks generated when they play.

Moreover, the drain paths 142*b* are formed to pass through the undersides (the bases) of the brushes 142*a* arranged on the backing cloth 142 in up and down directions and thus drain rainwater or water coming from melted snow in winter.

The silica sand 144 is located on one surface of the backing cloth 142 in such a way as to be poured into the brushes 142*a* for fixing the artificial turf 146.

The silica sand 144 poured into the brushes 142*a* serves to hold the artificial turf 146 inside the brushes 142*a* and to be thus prevented from escaping from the brushes 142*a* to the outside, and further, the silica sand 144 serves to stand up the artificial turf 146 fixedly planted into the brushes 142*a*.

Further, the artificial turf 146 is made of an antibacterial material, and a detailed explanation of the antibacterial material will be given below.

First, terms as used in the present invention will be defined as follows.

Visible light photocatalyst: Visible light is light with a wavelength of 400 (380) to 800 nm, and titanium dioxide as a representative photocatalyst is an ultraviolet light-responding photocatalyst using the light having a shorter wavelength than the short wavelength of a visible light region, so that a photocatalyst capable of using the light having the longer wavelength than the wavelength of titanium dioxide is defined as visible light photocatalyst.

Apatite is a mineral that is composed of phosphorus and calcium, which is contained in teeth and bones.

Photocatalytic slurry is a liquid produced by decomposing a photocatalyst with a solvent such as water, which is used as a material for photocatalytic paints.

Acetaldehyde is a kind of volatile organic compounds (VOCs) that is a bad odor of a cigarette, contained in adhesive agents and preservatives to emit harmful and irritating odor, a material for causing a sick house syndrome, and has an indoor concentration index of 20 ppb.

Antibacterial activity value is a value representing antibacterial performance prescribed in the JIS Z 2801 antimicrobial test. If it is assumed that the number of bacteria after culture for 24 hours is B and the number of bacteria after culture for 24 hours in the case of the addition of an antibacterial performance test material is C, an algebra value of B/C is defined as antibacterial activity value. The higher the value is, the better the antibacterial performance is, and if the antibacterial activity value is greater than or equal to 2.0 (a death rate greater than or equal to 99%), the antibacterial performance is good.

First Embodiment

A method for manufacturing an antibacterial material using a visible light photocatalyst and a recyclable plastic according to a first embodiment of the present invention is performed by mixing the visible light photocatalyst and the plastic (ABS resin, etc.) to manufacture the antibacterial material.

Referring first to the visible light photocatalyst, it was checked that nano magic (photocatalyst SNAP-10, as titanium dioxide coated with apatite) inactivated new type of corona virus (SARS-COV-2) with respect to a glass plate on which the nano magic (SNAP-10) was applied.

The test for inactivation of the new type of corona virus through the nano magic is carried out as follows.

The corona virus was inoculated into two types of test samples kept under given light illumination and at a dark place and then placed under white fluorescent lamps with 500 lx (UV cut lamp with a wavelength less than 380 nm) and 0 lx.

After action time had passed, virus was collected through a Phosphate-buffered saline (PBS) solution to calculate viral infectivity (virus plaque forming unit (pfu)/mL) through a plague diagnostic method.

Further, all tests were carried out by using appropriate pathogen sealing devices in a biosafety level 3 (BSL-3) laboratory.

It was found that under the light illumination condition of 500 lx, both of the test samples kept under the light illumination and at the dark place showed reduction in the viral infectivity as time had passed. In specific, the viral infectivity showed a reduction rate greater than or equal to 90% after one hour, a reduction rate greater than or equal to 99% after four hours, and a reduction rate of 99.806% after six hours.

It was found that under the keeping condition of 0 lx at the dark place, both of the test samples kept under the light illumination and at the dark place showed reduction in the viral infectivity as time had passed. In specific, the viral infectivity showed a reduction rate greater than or equal to 90% after one hour and a reduction rate greater than or equal to 99% after two hours.

If six hours had passed, the test sample kept under the light illumination showed the reduction of viral infectivity of 99.559% and the test sample kept at the dark place showed the reduction of viral infectivity of 99.438%.

As appreciated from the tests, the nano magic (photocatalyst which is titanium dioxide coated with apatite) used in the tests came into contact with the corona virus SARS-CoV-2, so that it was checked that the nano magic inactivated the virus. Through the test samples, it was found that the photocatalyst effectively prevented the contact transmission of the corona virus attached to the surface of a material.

<Reduction in Strain of Antibacterial Material Made by Mixing Visible Light Photocatalyst and ABS Resin>

Further, 0.01 to 100 ml of titanium isopropoxide (Ti[OCH (CH3 2]4) as a photocatalyst was dissolved in 10 to 1000 ml of ethyl alcohol, and next, 1 to 100 L of distilled water was added to the dissolved solution. After that, a small quantity (0.1 to 10 ml/L) of nitric acid or sulfuric acid was added to the mixture and had 2 to 48-hour reaction to make $TiO_2$ photocatalyst.

Meanwhile, a solution that was made by dissolving 0.001 mg to 100 g of a metal such as Zn, Ag, Cu, and the like or a mixture thereof into 1 L of acid and a solution that was made by dissolving 1 to 100 ml/L of tetraethyl orthosilicate (TEOS) and 100 ml/L of aminopropyl triethoxysilane into ethyl alcohol were mixed with each other at a rate of 1 to 1 to 1 to 5, and next, the mixture was co-precipitated in the $TiO_2$ photocatalyst sol at a room temperature to make the visible light photocatalyst.

Next, 149.15 to 149.35 parts by weight of acrylonitrile butadiene styrene copolymer (ABS) resin were mixed with 0.70 to 0.80 parts by weight of the visible light photocatalyst, and the mixing was carried out for four to six minutes.

In this case, the ABS resin is desirably a recyclable plastic, and if necessary, of course, the ABS resin may be a general plastic, not the recyclable plastic.

As mentioned above, referring to a degree of reduction of viral infectivity (removal efficiency of strain) of the antibacterial material made by mixing 149.15 to 149.35 parts by weight of the ABS resin and 0.70 to 0.80 parts by weight of the visible light photocatalyst for four to six minutes, the viral infectivity showed a reduction rate greater than or equal to 90% after one hour, a reduction rate greater than or equal to 99% after four hours, and a reduction rate of 99.806% after six hours (See FIG. 4).

Second Embodiment

A method for manufacturing an antibacterial material using a visible light photocatalyst and a recyclable plastic according to a second embodiment of the present invention is performed by mixing the visible light photocatalyst and the plastic such as ABS resin used in the first embodiment of the present invention and antibacterial copper powder (Cu) to make the antibacterial material.

<Reduction in Strain of Antibacterial Material Made by Mixing Visible Light Photocatalyst, ABS Resin, and Antibacterial Copper Powder>

A method for manufacturing a visible light photocatalyst according to the second embodiment of the present invention is carried out in the same manner as according to the first embodiment of the present invention.

In specific, 0.01 to 100 ml of titanium isopropoxide (Ti[OCH(CH3)2]4) as a photocatalyst was dissolved in 10 to 1000 ml of ethyl alcohol, and next, 1 to 100 L of distilled water was added to the dissolved solution. After that, a small quantity (0.1 to 10 ml/L) of nitric acid or sulfuric acid was added to the mixture and had 2 to 48-hour reaction to make $TiO_2$ photocatalyst.

Meanwhile, a solution that was made by dissolving 0.001 mg to 100 g of a metal such as Zn, Ag, Cu, and the like or a mixture thereof into 1 L of acid and a solution that was made by dissolving 1 to 100 ml/L of tetraethyl orthosilicate (TEOS) and 100 ml/L of aminopropyl triethoxysilane into ethyl alcohol were mixed with each other at a rate of 1 to 1 to 1 to 5, and next, the mixture was co-precipitated in the $TiO_2$ photocatalyst sol at a room temperature to make the visible light photocatalyst.

Next, 0.90 to 1.10 parts by weight of the visible light photocatalyst, 148 to 150 parts by weight of acrylonitrile butadiene styrene copolymer (ABS) resin, and 4 to 6 parts by weight of antibacterial copper powder were mixed with one another, and the mixing was carried out for four to six minutes.

In this case, the antibacterial copper powder is powder having given sizes of about 800 to 1,200 μm, and further, the antibacterial copper powder may have various sizes under the condition of being mixed with the visible light photocatalyst and the ABS resin.

As mentioned above, referring to a degree of reduction of viral infectivity (removal efficiency of strain) of the antibacterial material made by mixing 148 to 150 parts by weight of the ABS resin, 0.90 to 1.10 parts by weight of the visible light photocatalyst, and 4 to 6 parts by weight of antibacterial copper powder for four to six minutes, the viral infectivity showed a reduction rate greater than or equal to 90% after one hour, a reduction rate greater than or equal to 99% after four hours, and a reduction rate of 99.806% after six hours (See FIG. 5).

Third Embodiment

A method for manufacturing an antibacterial material using a visible light photocatalyst and a recyclable plastic according to a third embodiment of the present invention is performed by mixing the visible light photocatalyst and the plastic such as ABS resin used in the first embodiment of the present invention with silver nano powder and a non-recyclable plastic to manufacture the antibacterial material.

A method for manufacturing a visible light photocatalyst according to the third embodiment of the present invention is carried out in the same manner as according to the first and second embodiments of the present invention.

In specific, 0.01 to 100 ml of titanium isopropoxide (Ti[OCH(CH3)2]4) as a photocatalyst was dissolved in 10 to 1000 ml of ethyl alcohol, and next, 1 to 100 L of distilled water was added to the dissolved solution. After that, a small quantity (0.1 to 10 ml/L) of nitric acid or sulfuric acid was added to the mixture and had 2 to 48-hour reaction to make $TiO_2$ photocatalyst.

Meanwhile, a solution that was made by dissolving 0.001 mg to 100 g of a metal such as Zn, Ag, Cu, and the like or a mixture thereof into 1 L of acid and a solution that was made by dissolving 1 to 100 ml/L of tetraethyl orthosilicate (TEOS) and 100 ml/L of aminopropyl triethoxysilane into ethyl alcohol were mixed with each other at a rate of 1 to 1 to 1 to 5, and next, the mixture was co-precipitated in the $TiO_2$ photocatalyst sol at a room temperature to make the visible light photocatalyst.

Next, 0.5 to 1 parts by weight of the visible light photocatalyst, 0.5 to 1 parts by weight of silver nano powder, 50 parts by weight of a recyclable plastic, and 48 to 49 parts by weight of a non-recyclable plastic were mixed with one another, and the mixing was carried out for four to six minutes.

In this case, the silver nano powder is powder having given sizes of about 800 to 1,200 μm, and further, the silver nano powder may have various sizes under the condition of being mixed with the visible light photocatalyst, the recyclable ABS resin, and the non-recyclable ABS resin.

As mentioned above, referring to a degree of reduction of viral infectivity (removal efficiency of strain) of the antibacterial material made by mixing 0.5 to 1 parts by weight of the visible light photocatalyst, 0.5 to 1 parts by weight of the silver nano powder, 50 parts by weight of the recyclable plastic, and 48 to 49 parts by weight of the non-recyclable plastic for four to six minutes, the viral infectivity showed a reduction rate greater than or equal to 90% after one hour, a reduction rate greater than or equal to 99% after four hours, and a reduction rate of 99.806% after six hours (See FIG. 6).

As described above, the artificial turf system according to the present invention is configured to have the lower member located to come into close contact with the ground, the upper member spaced apart from the lower member by a given distance to allow the artificial turf assembly to be seated onto top thereof, and the shock absorbing pad placed between the lower member and the upper member and having given elasticity and drain functions, so that the artificial turf system can be resistant to various changes in environmental conditions, thereby providing excellent resistances such as heat resistance, cold resistance, and the like.

According to the present invention, further, the artificial turf system is configured to allow the elastic materials with given lengths of the shock absorbing pad having given thickness to be freely entangled in such a way as to be placed between the lower member and the upper member or to allow the plurality of springs to be spaced apart from one another in parallel with one another between the lower member and the upper member, so that when the player's activity occurs, the shock absorbing pad provides excellent shock absorbency (restoring force).

According to the present invention, furthermore, the artificial turf system is configured to allow the lower member and the upper member to be made of any one selected from the non-woven fabric, the PE material, and the PP material or two or more materials thereof and to allow the shock absorbing pad to be made of the elastic materials, thereby ensuring excellent durability.

According to the present invention, in addition, the artificial turf system is configured to allow the lower member and the upper member to be made of the environment-friendly PE material, thereby making it possible to perform environment-friendly recycling.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An artificial turf system comprising:

a lower member (110) located to come into close contact with a ground and made of any one selected from a non-woven fabric, a PE material, and a PP material or two or more materials thereof to prevent soil of the ground from being insertedly planted into a shock absorbing pad (130);

an upper member (120) spaced apart from the lower member (110) by a predetermined distance to allow an artificial turf assembly (140) to be seated onto top thereof, made of any one selected from a non-woven fabric, a PE material, and a PP material or two or more materials thereof to absorb water from the artificial turf assembly (140) seated onto top thereof, and having a plurality of drain holes (122) spaced apart from one another at predetermined intervals on top thereof to drain water from the artificial turf assembly (140) seated onto top thereof;

the shock absorbing pad (130) placed between the lower member (110) and the upper member (120) and made of materials having predetermined elasticity to absorb the shock received from the artificial turf assembly (140); and the artificial turf assembly (140) seated onto the top of the upper member (120) and having a backing cloth (142) having brushes (142*a*) located on one surface thereof, silica sand (144) poured inside the brushes (142*a*) where artificial turf (146) is planted, and the artificial turf (146) fixed to the inside of the brushes (142*a*) and made of an antibacterial material, wherein the artificial turf (146) made of the antibacterial material is manufactured by mixing a visible light photocatalyst and a recyclable plastic with each other, a visible light photocatalyst, a recyclable plastic, and antibacterial copper powder with one another, or a visible light photocatalyst, silver nano powder, a recyclable plastic, and a non-recyclable plastic with one another, and the respective components for making the antibacterial material are mixed for four to six minutes, wherein the antibacterial material is manufactured by mixing the visible light photocatalyst, the silver nano powder, the recyclable plastic, and the non-recyclable plastic with one another, wherein the antibacterial material manufactured by mixing the visible light photocatalyst, the silver nano powder, the recyclable plastic, and the non-recyclable plastic with one another contains 0.5 to 1 parts by weight of the visible light photocatalyst, 0.5 to 1 parts by weight of the silver nano powder, 50 parts by weight of the recyclable plastic, and 48 to 49 parts by weight of the non-recyclable plastic, which are mixed with one another for four to six minutes, and wherein the visible light photocatalyst comprises:

0.01 to 100 ml of titanium isopropoxide (Ti[OCH(CH3) 2]4) as a photocatalyst dissolved in 10 to 1000 ml of ethyl alcohol;

1 to 100 L of distilled water;

0.1 to 10 ml/L of nitric acid or sulfuric acid; and a mixture of dissolved 0.001 mg to 100 g of one of zinc, silver, and copper into 1 L of acid and a solution that was made by dissolving 1 to 100 ml/L of tetraethyl orthosilicate (TEOS) and 100 ml/L of aminopropyl triethoxysilane into ethyl alcohol.

2. The artificial turf system according to claim 1, wherein the shock absorbing pad (130) has a thickness between 0.3 and 1.5 mm and is configured to allow the materials having a predetermined elasticity with predetermined lengths to be freely entangled in such a way as to be placed between the lower member (110) and the upper member (120) or to allow a plurality of springs to be spaced apart from one another in parallel with one another between the lower member (110) and the upper member (120).

3. An artificial turf system comprising:

a lower member (110) located to come into close contact with a ground and made of any one selected from a non-woven fabric, a PE material, and a PP material or two or more materials thereof to prevent soil of the ground from being insertedly planted into a shock absorbing pad (130);

an upper member (120) spaced apart from the lower member (110) by a predetermined distance to allow an artificial turf assembly (140) to be seated onto top thereof, made of any one selected from a non-woven fabric, a PE material, and a PP material or two or more materials thereof to absorb water from the artificial turf assembly (140) seated onto top thereof, and having a plurality of drain holes (122) spaced apart from one another at predetermined intervals on top thereof to drain water from the artificial turf assembly (140) seated onto top thereof;

the shock absorbing pad (130) placed between the lower member (110) and the upper member (120) and made of materials having predetermined elasticity to absorb the shock received from the artificial turf assembly (140); and the artificial turf assembly (140) seated onto the top of the upper member (120) and having a backing cloth (142) having brushes (142*a*) located on one surface thereof, silica sand (144) poured inside the brushes (142*a*) where artificial turf (146) is planted, and the artificial turf (146) fixed to the inside of the brushes (142*a*) and made of an antibacterial material, wherein the artificial turf (146) made of the antibacterial material is manufactured by mixing a visible light photocatalyst and a recyclable plastic with each other, a visible light photocatalyst, a recyclable plastic, and antibacterial copper powder with one another, or a visible light photocatalyst, silver nano powder, a recyclable plastic, and anon-recyclable plastic with one another, and the respective components for making the antibacterial material are mixed for four to six minutes, wherein the antibacterial material manufactured by mixing the visible light photocatalyst and the recyclable plastic with each other contains 0.70 to 0.80 parts by weight of the visible light photocatalyst and 149.15 to 149.35 parts by weight of recyclable plastic, which are mixed with each other for four to six minutes, wherein the visible light photocatalyst comprises:

0.01 to 100 ml of titanium isopropoxide (Ti[OCH(CH3)2]4) as a photocatalyst dissolved in 10 to 1000 ml of ethyl alcohol;

1 to 100 L of distilled water;

0.1 to 10 ml/L of nitric acid or sulfuric acid; and a mixture of dissolved 0.001 mg to 100 g of one of zinc, silver, and copper into 1 L of acid and a solution that was made by dissolving 1 to 100 ml/L of tetraethyl orthosilicate (TEOS) and 100 ml/L of aminopropyl triethoxysilane into ethyl alcohol.

* * * * *